US008678873B2

(12) United States Patent
Lang et al.

(10) Patent No.: US 8,678,873 B2
(45) Date of Patent: Mar. 25, 2014

(54) DOG DISK

(75) Inventors: Darb Lang, Chicago, IL (US); Eugene Lang, Chicago, IL (US)

(73) Assignee: Lang Exterior, Inc., Chicago, IL (US)

( * ) Notice: Subject to any disclaimer, the term of this patent is extended or adjusted under 35 U.S.C. 154(b) by 205 days.

(21) Appl. No.: 13/287,125

(22) Filed: Nov. 2, 2011

(65) Prior Publication Data

US 2013/0109265 A1 May 2, 2013

(51) Int. Cl.
*A63H 27/00* (2006.01)
*A63H 33/00* (2006.01)

(52) U.S. Cl.
USPC ..... 446/46; 446/48

(58) Field of Classification Search
USPC ..... 446/46, 47, 48; 473/588, 589
See application file for complete search history.

(56) References Cited

U.S. PATENT DOCUMENTS

| | | | | |
|---|---|---|---|---|
| 3,359,678 | A | 12/1967 | Headrick | |
| 3,828,466 | A * | 8/1974 | Geiger | 446/48 |
| 4,132,030 | A * | 1/1979 | Lehman | 446/46 |
| 5,195,916 | A * | 3/1993 | Her | 446/46 |
| 5,360,363 | A * | 11/1994 | Levin | 446/46 |
| D412,768 | S * | 8/1999 | Huettner et al. | D30/160 |
| 5,934,966 | A * | 8/1999 | Ward | 446/46 |
| 7,335,085 | B2 * | 2/2008 | Lyman | 446/486 |
| 2008/0125001 | A1 * | 5/2008 | Barniak | 446/46 |

* cited by examiner

*Primary Examiner* — Nini Legesse
(74) *Attorney, Agent, or Firm* — Drinker Biddle & Reath LLP

(57) ABSTRACT

Embodiments of the disclosure include an apparatus that includes a first disk with a top first disk surface, a bottom first disk surface, and a first thickness and a first diameter. The apparatus further includes a second disk with top second disk surface, a bottom second disk surface, a second thickness and a second diameter. In addition, a joining contour couples the first disk and second disk and a lip member is coupled to the second disk such that the lip member is substantially perpendicular to the second disk. Another aspect of the apparatus may be a lifting member coupled to second disk, the lifting member capable of causing the apparatus to tilt when lying on a substantially flat surface with the lifting member touching the flat surface.

20 Claims, 10 Drawing Sheets

DOG DISK

BACKGROUND

Playing Frisbee is a popular past time as well as spending time with one's dog and thus many people may spend time with their dog by playing Frisbee. However, many Frisbees cannot be used by dogs because such Frisbees cannot be picked up by the dog when the Frisbee lies flat on the ground. Further, due to the design of many Frisbees, many dogs cannot grab the Frisbee by the mouth or flip over the Frisbees by their paw. Thus, there is a need for to improve Frisbee or other leisure disks such that dogs or other pets may participate in Frisbee (or disk) throwing leisure activities.

BRIEF SUMMARY

Embodiments of the disclosure address the deficiencies of the prior art of flying disks and Frisbees that are used in playing with dogs and other pets. This includes the ability for the dog or pet to grasp the flying disk with its mouth or paw. Further, embodiments of the disclosure include a lifting member to lift the disk off the ground such that it is parallel to the ground or tile the disk such that a portion is off the ground to allow the ability for the dog or pet to grasp the flying disk with its mouth or paw. However, different dogs and pets have different size paws or jaws as well as coordination to grasp the disk even though the disk is lifted off the ground or tilted at an angle. For example, a large dog with large paws or jaws may need the disk to be further off ground or at a large tilting angel to grasp the disk. Thus, additional embodiments include either a width adjusting mechanism and/or a height adjusting mechanism of the lifting member to adjust the height in which the disk is off the ground or the tilt angle of the disk when lying on the ground to ease the grasping of the disk by the dog or pet.

Embodiments of the disclosure include an apparatus that includes a first disk with a top first disk surface, a bottom first disk surface, and a first thickness and a first diameter. The apparatus further includes a second disk with top second disk surface, a bottom second disk surface, a second thickness and a second diameter. In addition, a joining contour couples the first disk and second disk and a lip member is coupled to the second disk such that the lip member is substantially perpendicular to the second disk. Another aspect of the apparatus may be a lifting member coupled to second disk, the lifting member capable of causing the apparatus to tilt when lying on a substantially flat surface with the lifting member touching the flat surface. Further, the first disk, the second disk, the joining contour, and lip member are made of a first apparatus material and the lifting member is made of a second apparatus material. The first apparatus material may include polyolefin.

Persons of ordinary skill in the art would understand that another lifting member may be coupled to the first disk instead of or in addition to the first lifting member. Such another lifting member may provide further ease of use for a dog or pet to grasp the disk.

Embodiments of the disclosure may also include an apparatus having a lifting member that is capable of having the first disk and second disk substantially parallel to the flat surface when the apparatus is lying on the substantially flat surface with the lifting member touching the flat surface. Further, the lifting member may include a hollow cylindrical member having a cylindrical thickness, an inner cylindrical diameter, an outer cylindrical diameter, and a cylindrical height, the hollow cylindrical member coupled to the bottom first disk surface such that the hollow cylindrical member is substantially perpendicular to the bottom first disk surface. In addition, the apparatus may include a first height adjusting mechanism coupled to the hollow cylindrical member such that the first height adjusting mechanism is capable of adjusting the cylindrical height of the hollow cylindrical member. An embodiment of the present disclosure may include a scoping mechanism as the first height adjusting mechanism. In addition, the apparatus may include a first width adjusting mechanism that adjusts the inner diameter of the hollow cylindrical member.

Further embodiments may include the lifting member includes a conical member having a conical circular base with a conical base diameter and a conical member height, the conical member coupled to the bottom first disk surface such that the conical member is substantially perpendicular to the bottom first disk surface. In addition, the apparatus may include a second height adjusting mechanism coupled to the conical member such that the second height adjusting mechanism is capable of adjusting the conical height of the conical member. Also, the apparatus may include a second width adjusting mechanism that adjusts the conical base diameter of the conical member.

Additional embodiments may include the lifting member includes a spherical member having a spherical diameter, a first spherical point and a second spherical point, the first spherical point of the spherical member coupled to the bottom first disk surface. Further, the apparatus may include a third height adjusting mechanism coupled to the spherical member and the bottom surface of the first disk such that the third height adjusting mechanism is capable of adjusting the distance between the first spherical point and the bottom surface of the first disk. Also, the apparatus may include a third width adjusting mechanism that adjusts the spherical diameter of the spherical member. Further embodiments include a fourth width adjusting mechanism that adjusts the width of the lifting member that includes first half hollow cylindrical member and a second half cylindrical member. The fourth width adjusting mechanism adjusting the width of the lifting member by adjusting the space between the first half hollow cylindrical member and a second half cylindrical member. An additional embodiment includes a fifth width adjusting mechanism that adjusts the width of the lifting member that includes first half spherical member and a second half spherical member. The fifth width adjusting mechanism adjusting the width of the lifting member by adjusting the space between the first half spherical member and a second half spherical member.

Other embodiments may have the second apparatus material include polyolefin. Also, first and second apparatus material includes polyethylene. However, different embodiments may have the second apparatus material includes a rubber core and felt as well as the first and second apparatus material includes recreational foam.

Although the embodiment described in the pending disclosure are discuss the disk apparatus to be used with dogs or other pets, persons of ordinary skill in the art would understand that such embodiments or other contemplated embodiments by such persons of ordinary skill in the art could be applied to humans as well. For example, children with undeveloped fine or gross motor skills may use embodiments of the pending disclosure as it would be easier for such children to grasp the exemplary disks as shown in the pending disclosure The foregoing summary is illustrative only and is not intended to be in any way limiting. In addition to the illustrative aspects, embodiments, and features described above, further aspects, embodiments, and features will become apparent by reference to the drawings and the following detailed description

BRIEF DESCRIPTION OF THE SEVERAL VIEWS OF THE DRAWINGS

The accompanying drawings, which are incorporated in and constitute part of this specification, illustrate embodiments of the invention and together with the description serve to explain the principles of the present disclosure. The embodiments illustrated herein are presently preferred, it being understood, however, that the invention is not limited to the precise arrangements and instrumentalities shown, wherein.

DETAILED DESCRIPTION OF THE INVENTION

Figure 1:
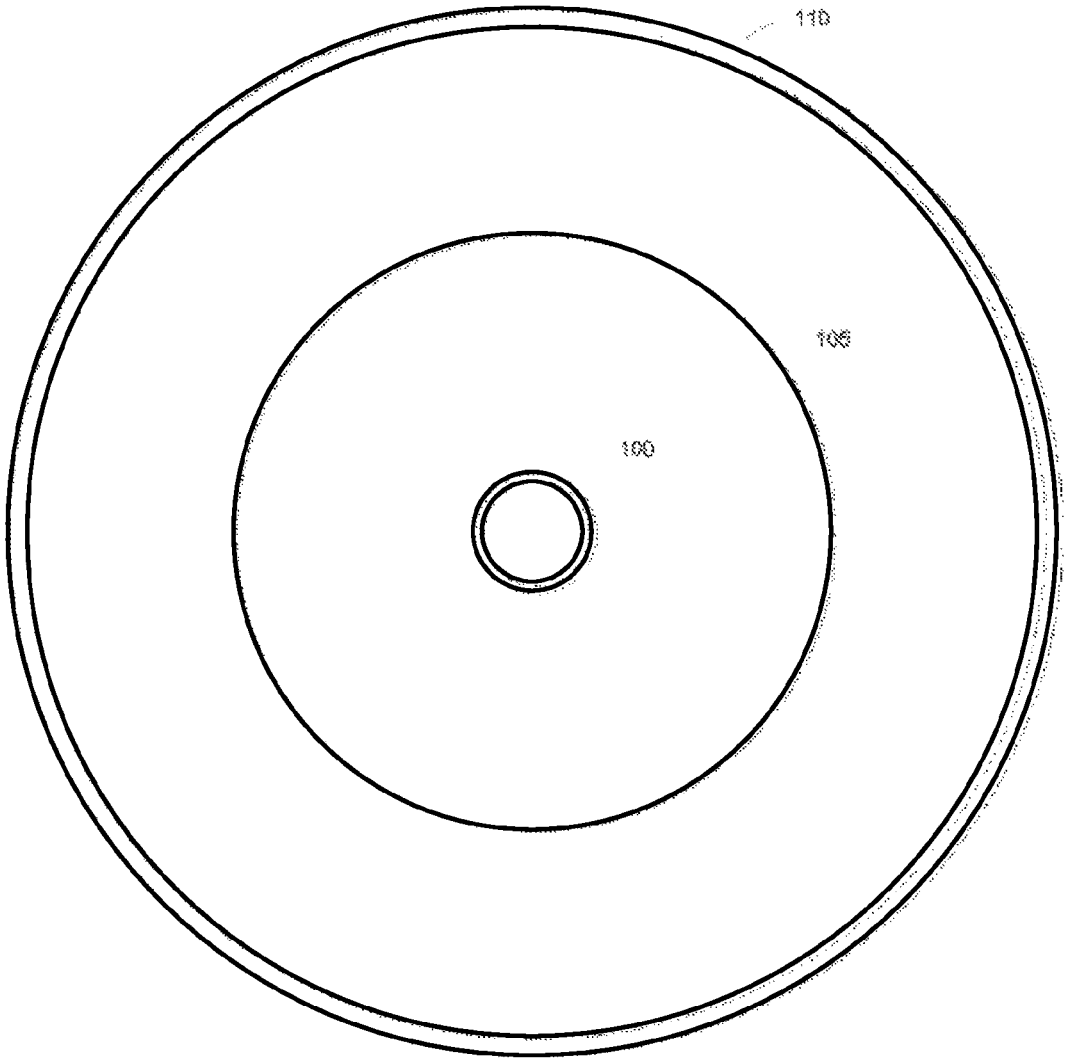
FIG. 1 is a top view of an exemplary embodiment of a disk for play with a dog or pet in accordance with the present disclosure.

In the following detailed description, reference is made to the accompanying drawings, which for a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of difference configurations, all of which are explicitly contemplated herein. Further, in the following description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

Playing Frisbee is a popular past time as well as spending time with one's dog and thus many people may spend time with their dog by playing Frisbee. However, many Frisbees cannot be used by dogs because such Frisbees cannot be picked up by the dog when the Frisbee lies flat on the ground. Further, due to the design of many Frisbees, many dogs cannot grab the Frisbee by the mouth or flip over the Frisbees by their paw. Thus, there is a need for to improve Frisbee or other leisure disks such that dogs or other pets may participate in Frisbee (or disk) throwing leisure activities. Embodiments of the disclosure address the deficiencies of the prior art of flying disks and Frisbees that are used in playing with dogs and other pets. This includes the ability for the dog or pet to grasp the flying disk with its mouth or paw. Further, embodiments of the disclosure include a lifting member to lift the disk off the ground such that it is parallel to the ground or tile the disk such that a portion is off the ground to allow the ability for the dog or pet to grasp the flying disk with its mouth or paw. However, different dogs and pets have different size paws or jaws as well as coordination to grasp the disk even though the disk is lifted off the ground or tilted at an angle. For example, a large dog with large paws or jaws may need the disk to be further off ground or at a large tilting angel to grasp the disk. Thus, additional embodiments include either a width adjusting mechanism and/or a height adjusting mechanism of the lifting member to adjust the height in which the disk is off the ground or the tilt angle of the disk when lying on the ground to ease the grasping of the disk by the dog or pet.

FIG. 1 is a top view of an exemplary embodiment of a disk for play with a dog or pet in accordance with the present disclosure. The disk is comprised of a large disk 110 and a small disk 105 coupled together by a joining member (not shown). Further, the disk is comprised of a lifting member 100 that allows a dog or other pet to grasp the disk with its mouth or paw by lifting the disk such that it is off the ground or some other substantially flat landing surface or by titling the disk such that a portion of the disk is off the ground thereby allowing a dog or pet to grasp the disk with its mouth or paws. The lifting member 100 may be of different shapes and configurations that include but are not limited to, a hollow or solid cylinder, a hollow or solid cone, or a hollow or solid sphere. A hollowness of the lifting member may be substantially hollow or partially hollow.

The disk and lifting member may be made of the same material such as polyolefin or polyethylene or some other similar material. Polyolefin is a polymer produced from olefin (e.g. alkene) as a monomer. Polyethylene is the polyolefin produced by polymerizing the olefin ethylene (e.g. polyalkene). Polyethylene is of a light weight thereby potentially increasing aerodynamics of the disk to stay in flight longer than if made with other heavier materials. Further, polyethylene is a material that is considered safe if ingested by pets. Further embodiments of the present disclosure may have the lifting member be made of a different material than the disk. For example, the lifting member may be made of a recreational foam used in many leisure materials such as indoor volleyballs, footballs, etc. or a synthetic or other type of felt that may be used in tennis balls. Other embodiments may have the material of the lifting member be the same as chew toys for dogs and pets. Making the lifting member of such materials provides further appeal to the dog or pet to play with the disk. Also, making the lifting material with another material (e.g. lighter weight than the disk material) may potentially increase the aerodynamics of the disk.

Figure 2:
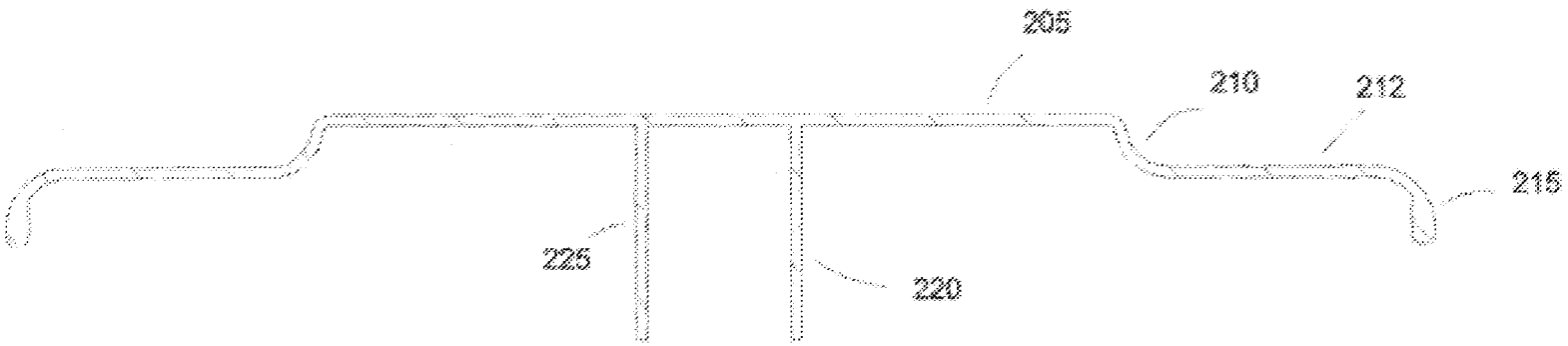
FIG. 2 is a cross section view of an exemplary embodiment of a disk for play with a dog or pet in accordance with the present disclosure.

FIG. 2 is a cross section view of an exemplary embodiment of a disk for play with a dog or pet in accordance with the present disclosure. As mentioned when describing FIG. 1, the disk is comprised of a large disk 212 and a small disk 205 coupled by a joining member 210. Further, a lip member 215 is coupled to the large disk 212. In addition, a lifting member (220 and 225) is coupled to the small disk 205. As shown in FIG. 2, when lying on ground or other substantially flat landing surface, the disk is off the ground a certain height by the lifting member (220 and 225). This allows a dog or pet to better grasp the disk with its jaws or paws thereby make playing with the disk more enjoyable.

Persons of ordinary skill in the art would understand that another lifting member may be coupled to the first disk instead of or in addition to the first lifting member. Such another lifting member may provide further ease of use for a dog or pet to grasp the disk.

Figure 3:
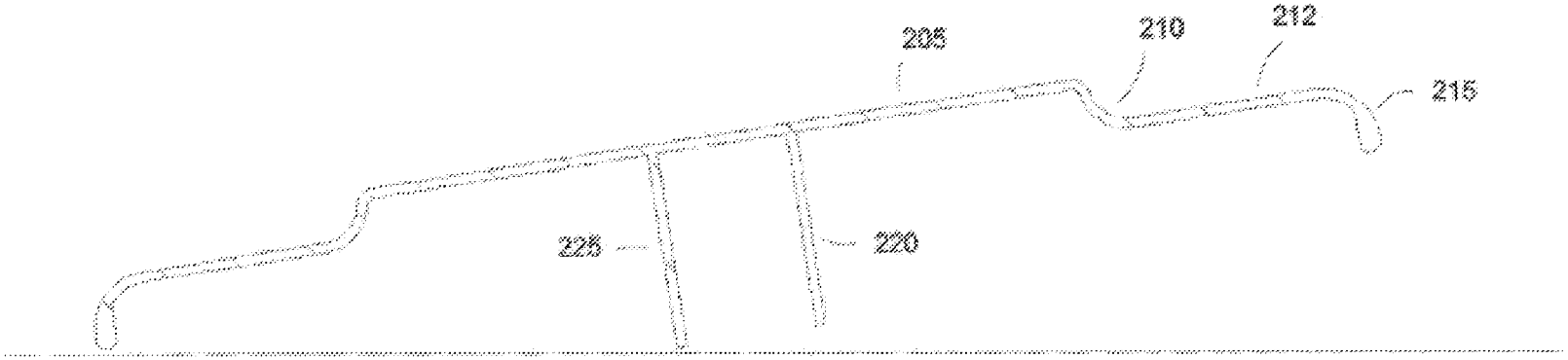
FIG. 3 is another cross section view of an exemplary embodiment of a disk for play with a dog or pet in accordance with the present disclosure showing the disk tilted on a substantially flat surface.

FIG. 3 is another cross section view of an exemplary embodiment of a disk for play with a dog or pet in accordance with the present disclosure showing the disk tilted on a substantially flat surface. FIG. 3 includes the components shown in FIG. 2 but in addition shows other functional aspects of the lifting member (220 and 225). That is, the lifting member (220 and 225) tilts the disk at an angle that makes the disk not parallel to a flat landing surface on which the disk is lying but instead tilts the disk at an angle such that a portion of the disk s off the ground. Thus, the disk allows a dog or other pet to grasp the disk when the disk is lying on the ground or other flat surface using the pet's mouth or paw.

Figure 4B:
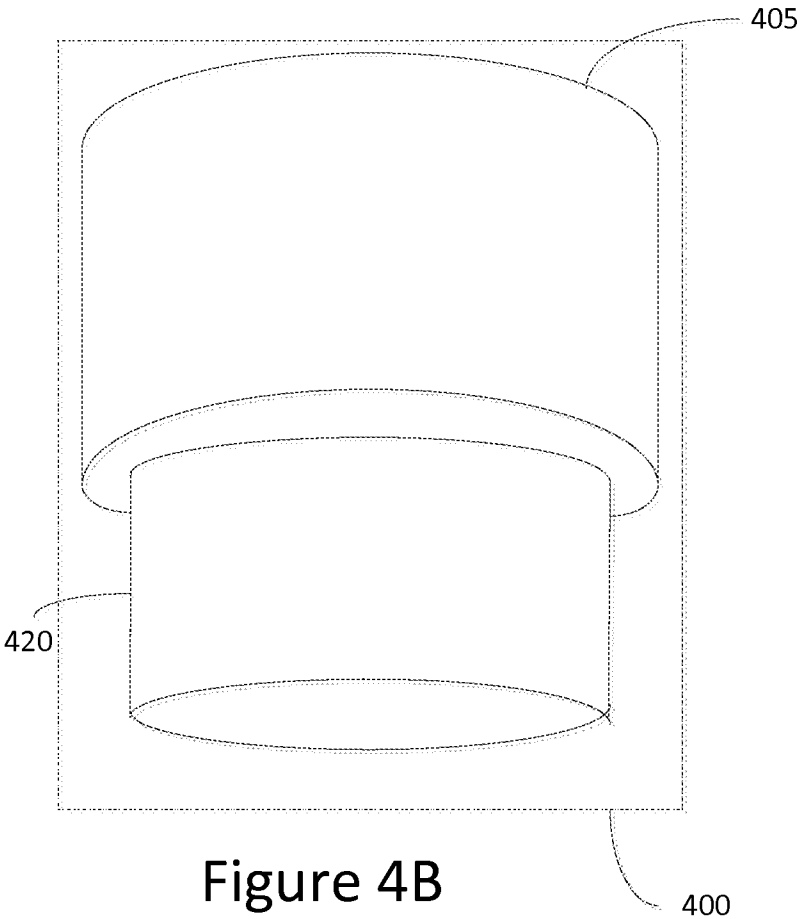
FIGS. 4A and 4B show an exemplary embodiment of a height adjusting mechanism for a lifting member of a disk in accordance with the present disclosure.
Figure 4A:
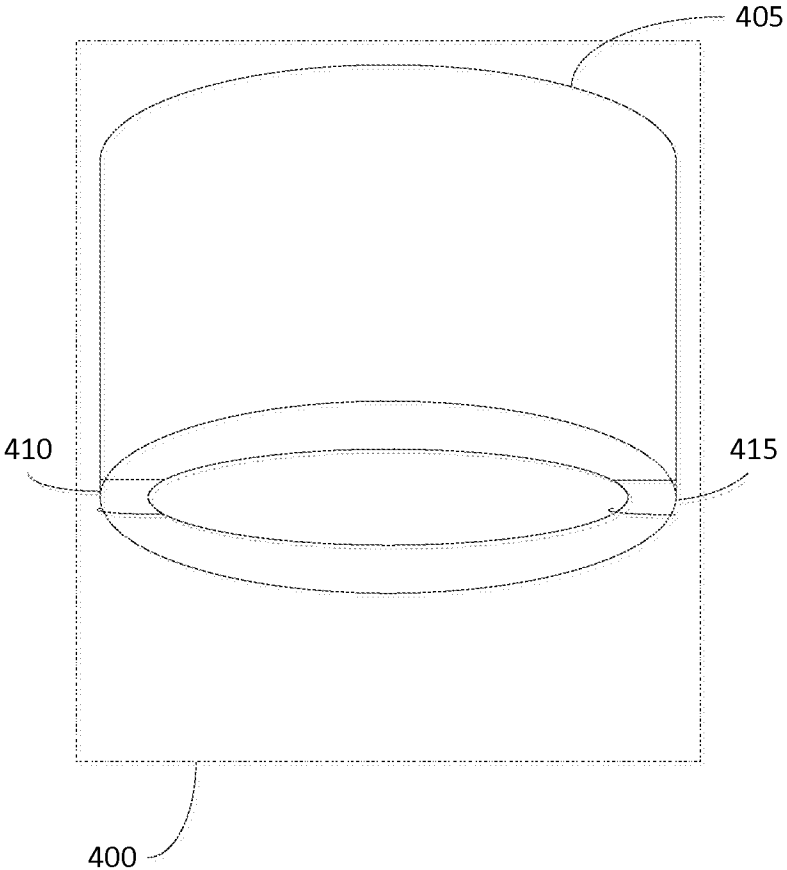

FIGS. 4A and 4B show an exemplary embodiment of a height adjusting mechanism 400 for a lifting member 400 of a disk in accordance with the present disclosure. The height adjustment mechanism 400 may be integrated into the lifting member 400. Referring to FIG. 4A, the lifting member may include an upper lifting member 405 that may have a shape of a hollow cylinder. Further, as part of the height adjusting mechanism are two latches (410 and 415). Referring to FIG. 4B, the two latches (410 and 415) have been removed such that an inner hollow cylinder which also may be called a lower lifting member 420 fall down to adjust the height of the lifting member 400.

Further, in the embodiment shown in FIGS. 4A and 4B, the height adjusting mechanism 400 may be a scoping mechanism. That is, the lifting member 400 may include two concentric hollow cylinders (405 and 420) and may be placed in one or more height positions to adjust the overall height of the lifting member. Further, the inner hollow cylinder 420 may at a same height as the outer hollow cylinder 405 at a first position (See FIG. 4A). The inner hollow cylinder 420 may be secured in the first position by one or more latches (410 and 415). In addition, a user may remove the one or more latches (410 and 415) such that the inner cylinder 420 falls down telescopically such that the height of the lifting member 420 is at a second position. As mentioned in the present disclosure, increasing the height of the lifting member 400 potentially increases a dog's or pet's ability to grasp the disk with its jaws or paws. This may be done by either having the disk further off the ground at a tilted angle or with the disk parallel to the ground or substantially flat landing surface.

Figure 5A:
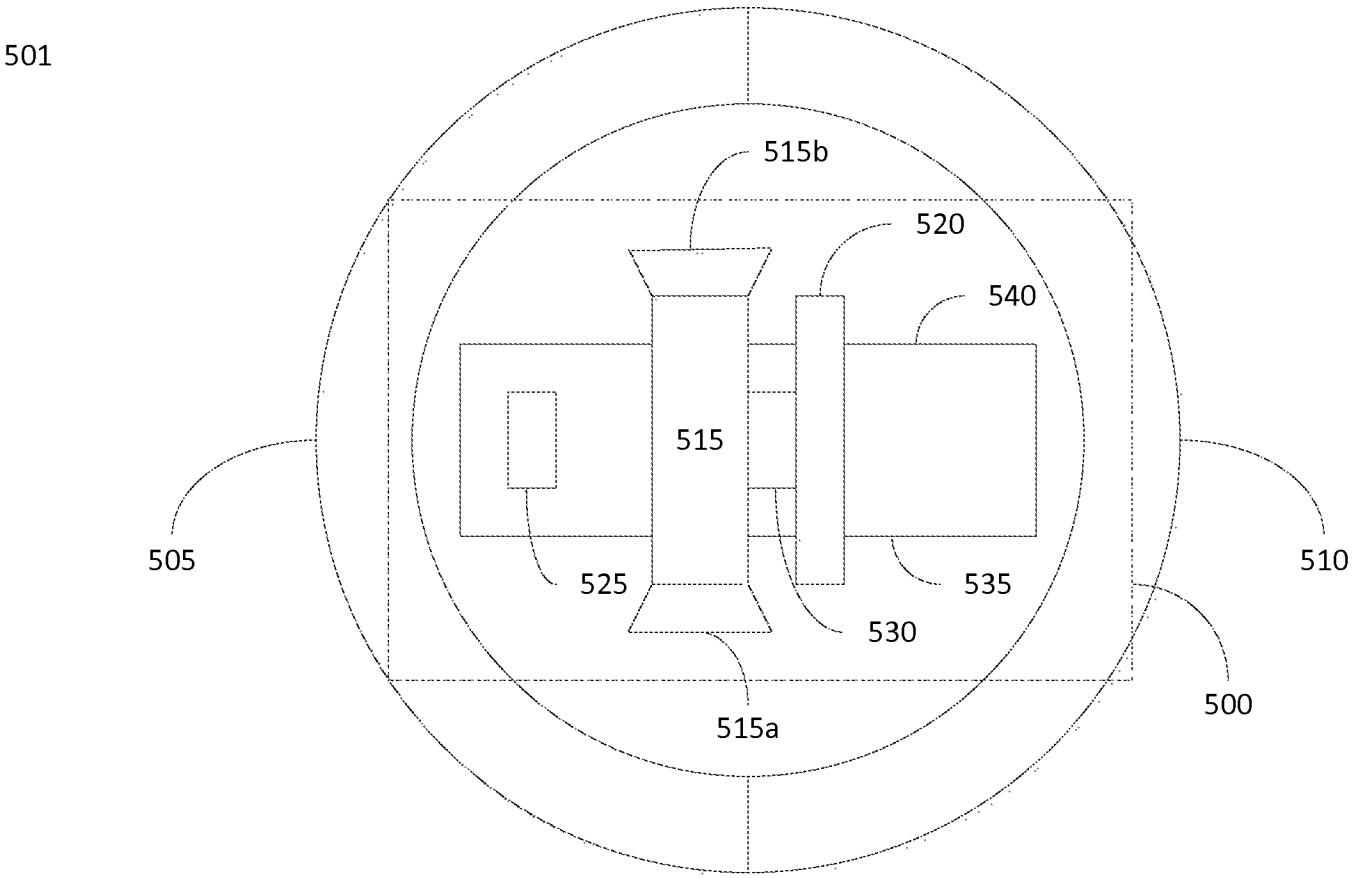
FIGS. 5A, 5B, and 5C show an exemplary embodiment of a width adjusting mechanism for a lifting member of a disk in accordance with the present disclosure.
Figure 5B:
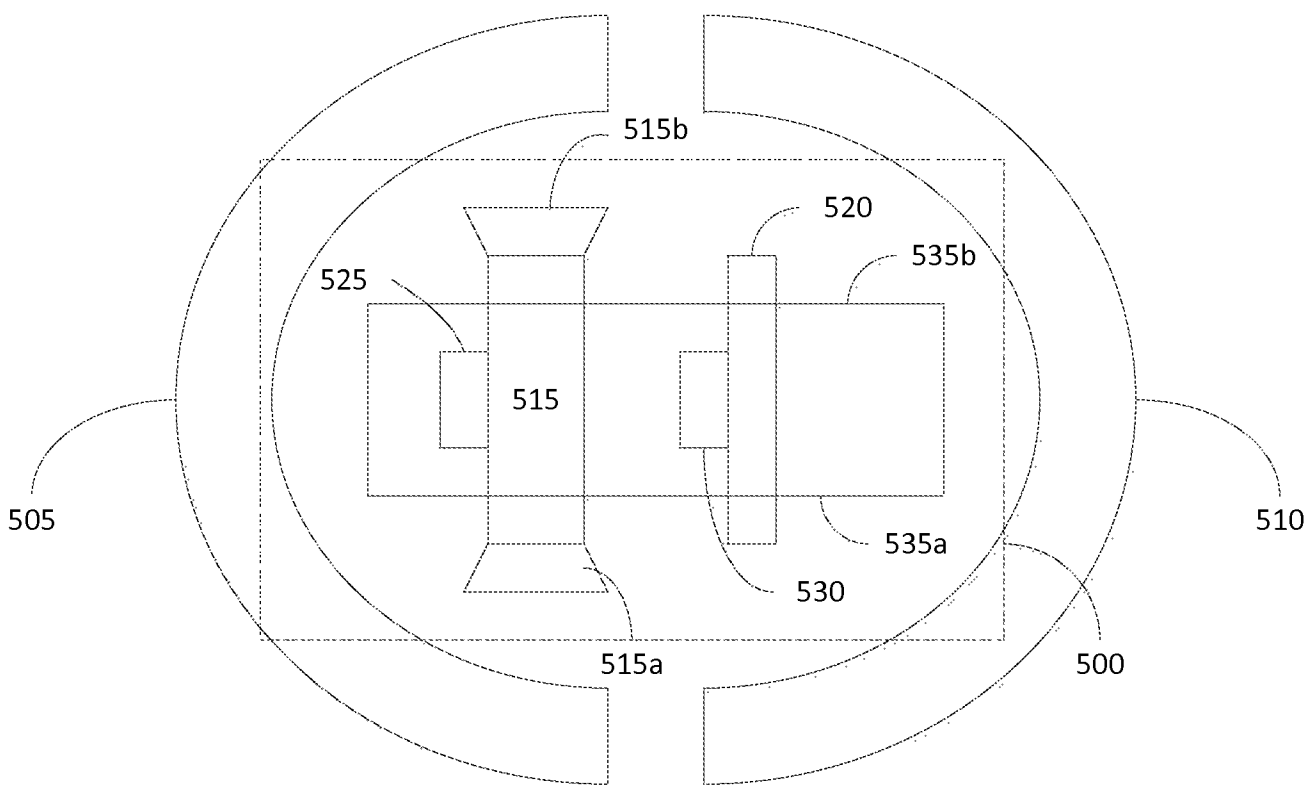
Figure 5C:
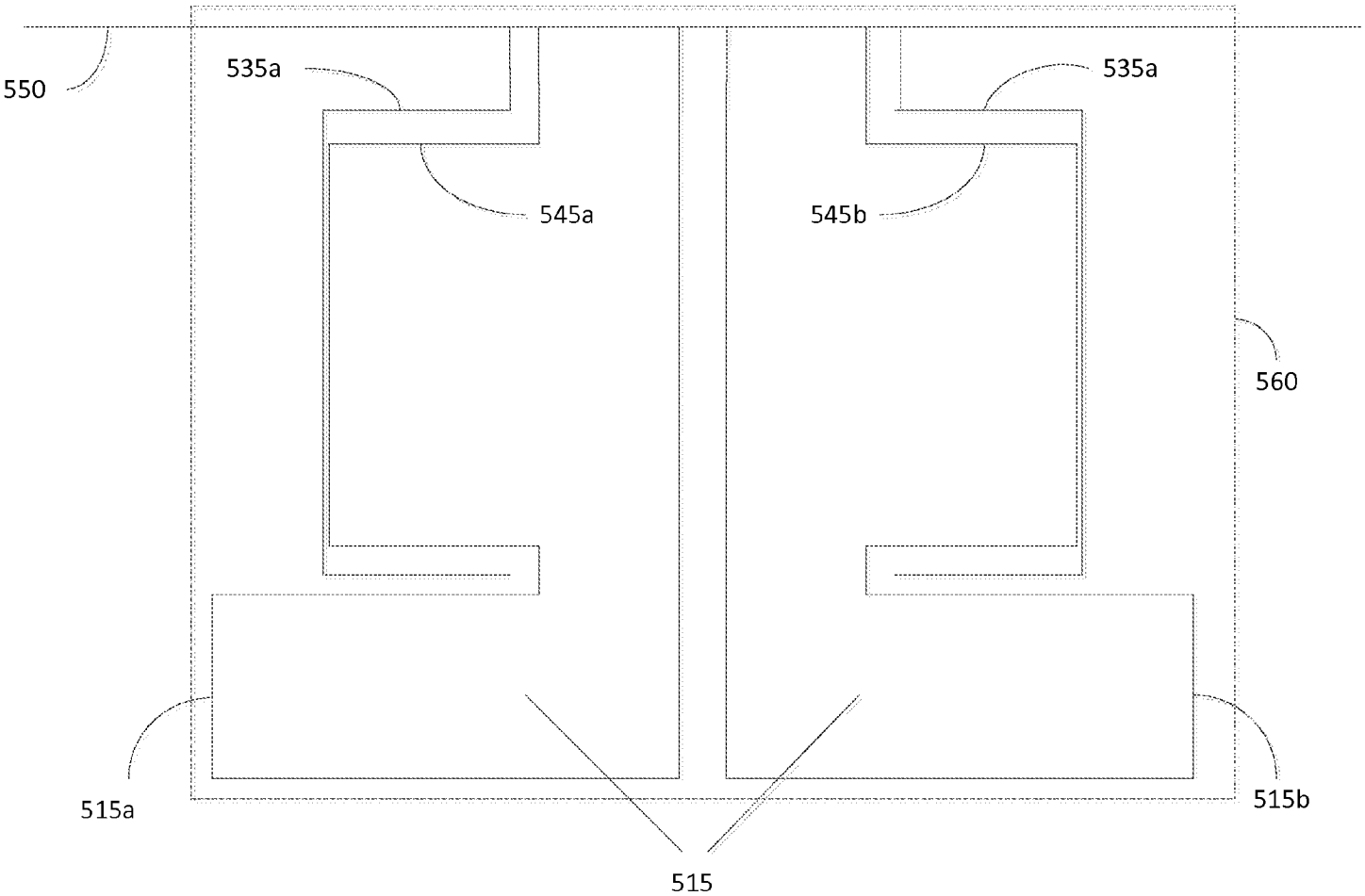

FIGS. 5A, 5B, and 5C show an exemplary embodiment of a width adjusting mechanism 500 for a lifting member 501 of a disk in accordance with the present disclosure. In the embodiments shown in FIGS. 5A, 5B, 5C and referring to FIG. 5A in particular, the lifting member 501 may be a hollow cylinder having two halves, a left half cylinder 505 and a right half-cylinder 510. Further, the lifting member 501 may have a width adjusting mechanism 500 for the lifting member 501 coupled to the disk. The width adjusting mechanism 500 may include a sliding mechanism (515, 515*a* and 515*b*), a track 540, a left stopper 525, a right stopper 530, and a right stopper reinforcement 520. In FIG. 5A, the sliding mechanism is in a first position such that the lifting member 501 has its shortest width. A user of the disk may press the top and bottom ends (515*a* and 515*b*) of the sliding mechanism such that the sliding mechanism 515 moves from the first position shown in FIG. 5A to a second position as shown in FIG. 5B. The sliding mechanism 515 may be a placed in the first position by having the sliding mechanism coupled to one or more sides of a track 540 as known by persons of ordinary skill in the art. Referring to FIG. 5C, an embodiment of moving the sliding mechanism (515, 515*a* and 515*b*) and hence adjust the width of a lifting member may be implemented by a cantilever 560 or similar lever mechanism known in the art. The sliding mechanism (515, 515*a* and 515*b*) may be part of a cantilever mechanism 560 that is coupled to a disk 550 by two inserts (545*a* and 545*b*). A cantilever system generally can be described by a structure anchored at only one such that the structure supports a load.

In a steady state position such that the sliding mechanism is resting at a first position or second position, the inserts (545*a* and 545*b*) of the sliding mechanism 515 may press against a side of the track (535*a* and 535*b*) securing the sliding mechanism in place. In a transition state, such that a user moves the sliding mechanism from the first position to the second position, the user may push each end (515*a* and 515) of the sliding mechanism (515) causing each insert (545*a* and 545*b*) to move away from the side of each respective end (535*a* and 535*b*) of the track. As a result, the user may move the sliding mechanism 515 from the first position (See FIG. 5A) to a second position (See FIG. 5B) thereby increasing the width of the lifting member.

Other sliding mechanisms may include, but are not limited to, a mechanism that allows a hole each side of a track (535*a* and 535*b*) to be the shape of the each insert (545*a* and 545*b*) such that each insert (545*a* and 545*b*) partially passes through each hole locking or stabilizing the sliding mechanism 515 in place at a first position. Further, a user pushing the ends (515*a* and 515*b*) causes each insert (545*a* and 545*b*) be free of each hole side of the track (535 and 535*b*) and allows the user to move the sliding mechanism 515 from the first position (See FIG. 5A) to a second position (See FIG. 5B) thereby increasing the width of the lifting member.

Increasing the width of the disk offers a user the ability to have the disk more likely to be parallel to the ground when landing rather than on an angle. The user's dog or pet may prefer or has more success grasping the disk if it is parallel to the ground rather than tilted on an angle with respect to the ground.

Figure 6A:
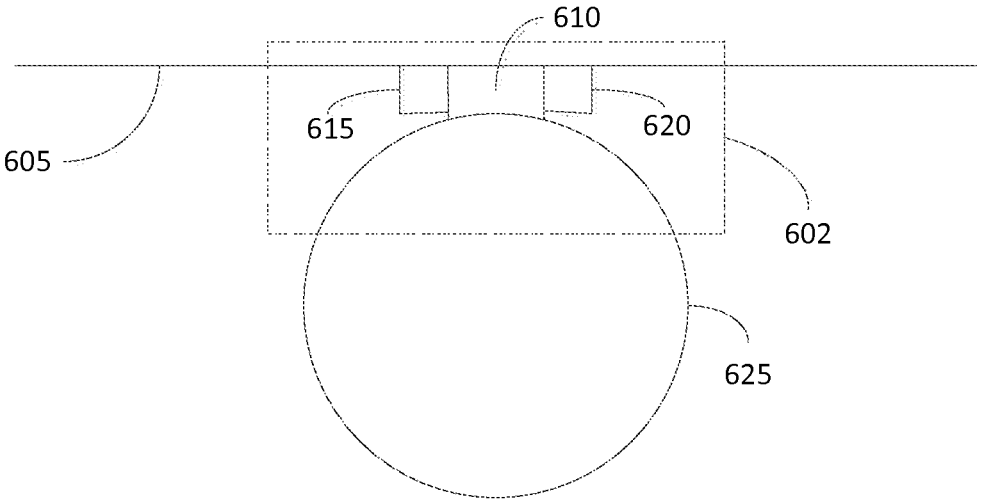
FIGS. 6A, 6B, 6C, and 6D show an exemplary embodiment of a height adjusting mechanism for a lifting member of a disk in accordance with the present disclosure.
Figure 6B:
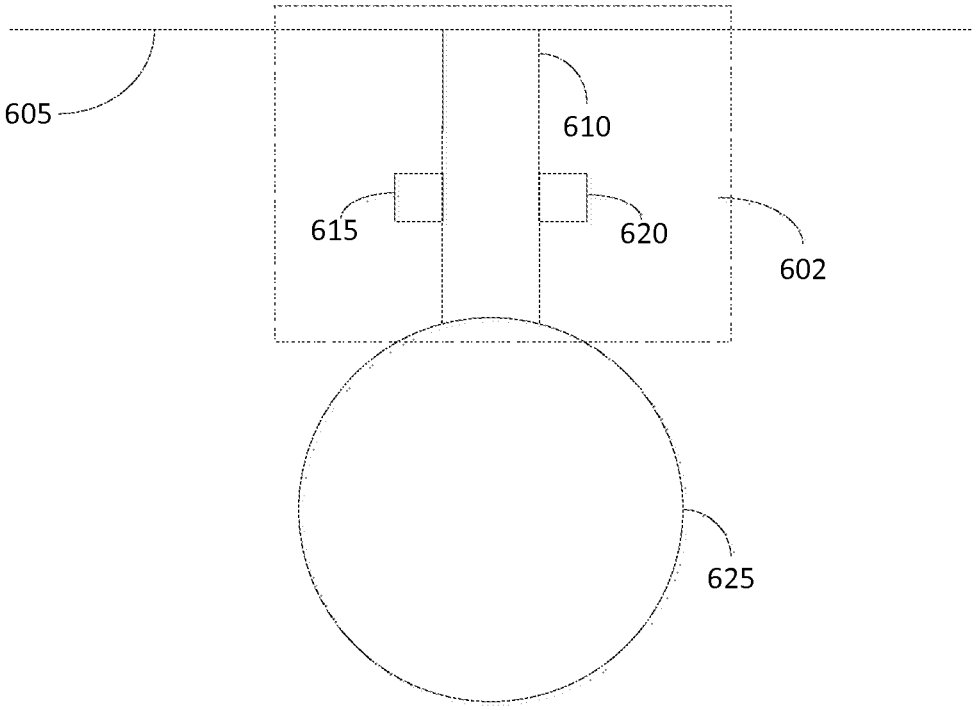

FIGS. 6A, 6B, 6C, and 6D show an exemplary embodiment of a height adjusting mechanism 602 for a lifting member 625 of a disk in accordance with the present disclosure. Referring to FIG. 6A, the height adjusting mechanism 602 may be coupled to the disk 605 and coupled to the lifting member 625. In the embodiment shown in FIGS. 6A-6D, the lifting member 625 is in the shape of a sphere. The height adjusting mechanism may include a support structure 610 and two spring pegs (615 and 620) each on a side of the support structure 610. In FIG. 6A, the height adjustment mechanism 602 is in a first position. Referring to FIG. 6B, the height adjusting mechanism 602 may be moved to a second position. In one embodiment of the height adjusting mechanism 602, a user may push in each spring peg (615 and 620) such that the spring within each peg (615 and 620) is compressed and then can be slid to the next hole thereby adjusting the height of the lifting member 625.

Figure 6C:
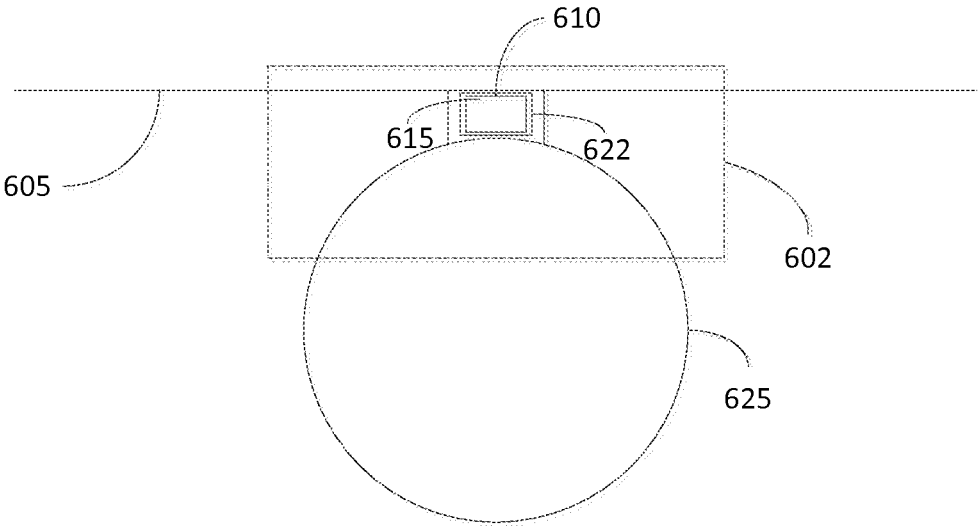
Figure 6D:
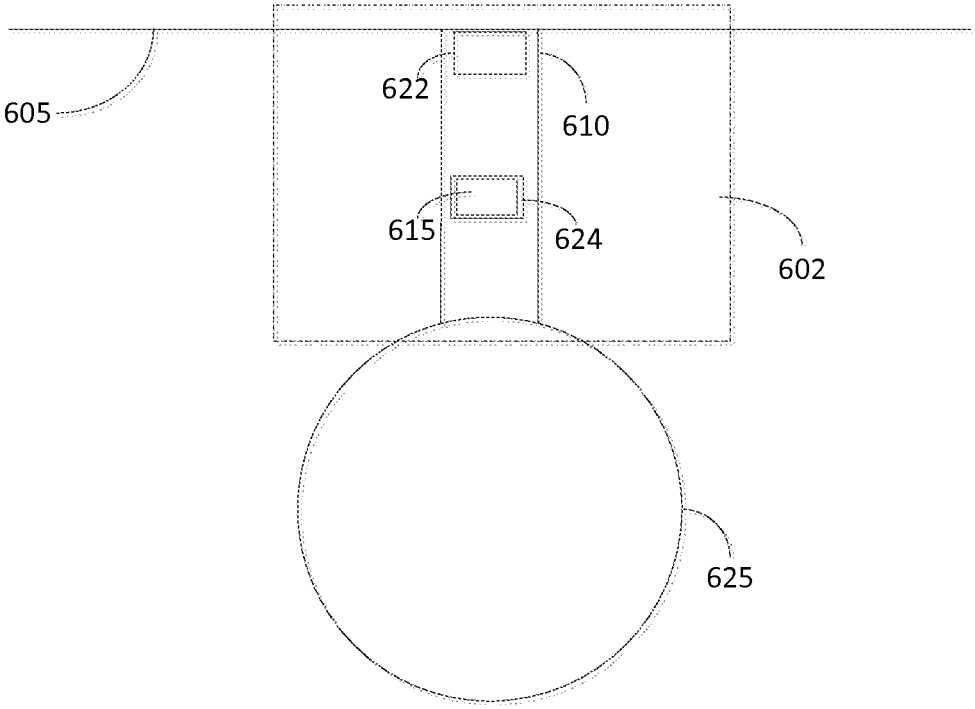

Referring to FIG. 6C, the height adjusting mechanism 602 is in a first position similar to FIG. 6A. A spring peg 615 is shown to be passing through a hole 622 thereby securing the height adjusting mechanism 602 in the first position. Referring to FIG. 6D, the height adjusting mechanism 602 has been moved to a second position. In one embodiment of the height adjusting mechanism 602, a user may push in a spring peg 615 such that the spring within the peg 615 is compressed and then can be slid to the next hole 624 thereby adjusting the height of the lifting member 625.

Figure 7:
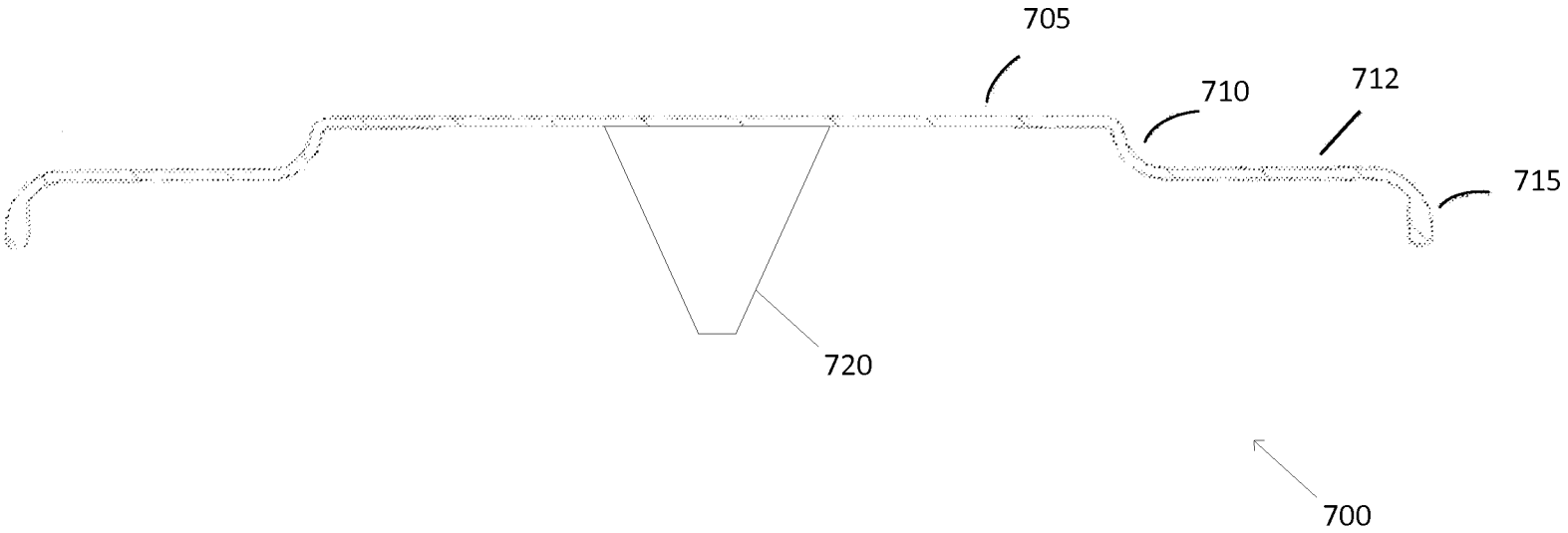
FIG. 7 is another cross section view of an exemplary embodiment of a disk for play with a dog or pet in accordance with the present disclosure.

FIG. 7 is another cross section view of an exemplary embodiment of a disk for play with a dog or pet in accordance with the present disclosure. The disk 700 comprises a large disk 712 and a small disk 705 coupled by a joining member 710. Further, a lip member 715 is coupled to the large disk 712. The disk 700 includes a lifting member 720. The lifting member 720 comprises a solid cone or conical member.

Persons of ordinary skill in the may use the height adjusting mechanisms in one embodiment in another embodiment as a width adjusting mechanism for a lifting member. Conversely, persons of ordinary skill in the may use the width adjusting mechanisms in one embodiment as height adjusting mechanism in another embodiment for a lifting member. For example, a sliding mechanism may include a spring peg passing through first hole in a first position (See FIG. 5A-5D). A user may then press to compress a spring in the peg such that it may slide the slide mechanism t a second position such that the spring peg to pass through a second hole at a second position. Further, persons of ordinary skill in the art may modify a width adjusting mechanism of a lifting member to be a height adjusting mechanism using techniques known in the art.

Increasing the height of the disk offers a user the ability to have the disk more likely to be tilted at angle to the ground when landing rather than on parallel to the ground. The user's dog or pet may prefer or has more success grasping the disk if it is tilted on angle to the ground rather than parallel to the ground.

Although the embodiment described in the pending disclosure are discuss the disk apparatus to be used with dogs or other pets, persons of ordinary skill in the art would understand that such embodiments or other contemplated embodiments by such persons of ordinary skill in the art could be applied to humans as well. For example, children with undeveloped fine or gross motor skills may use embodiments of the pending disclosure as it would be easier for such children to grasp the exemplary disks as shown in the pending disclosure Note that the functional blocks, methods, devices and systems described in the present disclosure may be integrated or divided into different combination of systems, devices, and functional blocks as would be known to those skilled in the art.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, the present application may be implemented using a general purpose or dedicated processor running a software application through volatile or non-volatile memory. Also, the hardware objects could communicate using electrical signals, with states of the signals representing different data.

It should be further understood that this and other arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions, or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus comprising:

a first disk with a top first disk surface, a bottom first disk surface, a first thickness, and a first diameter;

a second disk with a top second disk surface, a bottom second disk surface, a second thickness, and a second diameter;

a joining contour that couples the first disk and the second disk;

a lip member coupled to the second disk such that the lip member is substantially perpendicular to the second disk;

a lifting member coupled to the first disk, the lifting member capable of causing the apparatus to tilt when lying on a substantially flat surface;

wherein the lifting member comprises a hollow cylindrical member coupled to the bottom first disk surface such that the hollow cylindrical member is substantially perpendicular to the bottom first disk surface.

2. The apparatus of claim 1, wherein the lifting member is capable of having the first disk and the second disk substantially parallel to the substantially flat surface when the apparatus is laying on the substantially flat surface.

3. The apparatus of claim 1, wherein the hollow cylindrical member has a cylindrical thickness, an inner cylindrical diameter, an outer cylindrical diameter, and a cylindrical height.

4. The apparatus of claim 1, wherein the first disk, the second disk, the joining contour, and the lip member are made of a first apparatus material and the lifting member is made of a second apparatus material;

wherein the first apparatus material includes polyolefin;

wherein the second apparatus material includes polyolefin.

5. The apparatus of claim 1, wherein the first disk, the second disk, the joining contour, and the lip member are made of a first apparatus material and the lifting member is made of a second apparatus material;

wherein the first apparatus material includes polyethylene.

6. The apparatus of claim 1, wherein the first disk, the second disk, the joining contour, and the lip member are made of a first apparatus material and the lifting member is made of a second apparatus material;

wherein the second apparatus material includes polyethylene.

7. The apparatus of claim 1, wherein the first disk, the second disk, the joining contour, and the lip member are made of a first apparatus material and the lifting member is made of a second apparatus material;

wherein the second apparatus material includes a rubber core and felt.

8. The apparatus of claim 1, wherein the first disk, the second disk, the joining contour, and the lip member are made of a first apparatus material and the lifting member is made of a second apparatus material;

wherein the first apparatus material includes recreational foam and the second apparatus material includes recreational foam.

9. The apparatus of claim 1, wherein another lifting member is coupled to the first disk.

10. An apparatus, comprising:

a first disk with a top first disk surface, a bottom first disk surface, a first thickness, and a first diameter;

a second disk with a top second disk surface, a bottom second disk surface, a second thickness, and a second diameter;

a joining contour that couples the first disk and the second disk;

a lip member coupled to the second disk such that the lip member is substantially perpendicular to the second disk;

a lifting member coupled to the first disk, the lifting member capable of causing the apparatus to tilt when lying on a substantially flat surface; and a height adjusting mechanism coupled to the lifting member such that the first height adjusting mechanism is capable of adjusting a height of the lifting member.

11. The apparatus of claim 10, wherein the first height adjusting mechanism is a telescoping mechanism.

12. The apparatus of claim 10, wherein the lifting member includes a conical member having a conical circular base with a conical base diameter and a conical member height, the conical member coupled to the bottom first disk surface such that the conical member is substantially perpendicular to the bottom first disk surface.

13. The apparatus of claim 12, wherein the height adjusting mechanism is coupled to the conical member such that the height adjusting mechanism is capable of adjusting the conical member height of the conical member.

14. The apparatus of claim 10, wherein the lifting member includes a spherical member having a spherical diameter, a first spherical point, and a second spherical point;

wherein the first spherical point of the spherical member is adjacent to the bottom first disk surface.

15. The apparatus of claim 14, wherein the height adjusting mechanism is coupled to the spherical member and the bottom surface of the first disk such that the height adjusting mechanism is capable of adjusting a distance between the first spherical point and the bottom surface of the first disk.

16. The apparatus of claim 10, wherein the lifting member comprises a first half hollow cylindrical member and a second half hollow cylindrical member;

wherein the width adjusting mechanism is capable of adjusting the width of the lifting member by adjusting a space between the first half hollow cylindrical member and the second half hollow cylindrical member.

17. The apparatus of claim 10, wherein the lifting member comprises a first half spherical member and a second half spherical member;

wherein the width adjusting mechanism is capable of adjusting the width of the lifting member by adjusting a space between the first half spherical member and the half spherical member.

18. An apparatus, comprising:

a first disk with a top first disk surface, a bottom first disk surface, a first thickness, and a first diameter;

a second disk with a top second disk surface, a bottom second disk surface, a second thickness, and a second diameter;

a joining contour that couples the first disk and the second disk;

a lip member coupled to the second disk such that the lip member is substantially perpendicular to the second disk;

a lifting member coupled to the first disk, the lifting member capable of causing the apparatus to tilt when lying on a substantially flat surface; and a width adjusting mechanism that adjusts a width of the lifting member.

19. The apparatus of claim 18, wherein the lifting member includes a conical member having a conical circular base with a conical base diameter and a conical member height, the conical member coupled to the bottom first disk surface such that the conical circular base of the conical member is substantially perpendicular to the bottom first disk surface;

wherein the width adjusting mechanism is capable of adjusting the conical base diameter of the conical member.

20. The apparatus of claim 18, wherein the lifting member includes a spherical member having a spherical diameter, a first spherical point, and a second spherical point;

wherein the first spherical point of the spherical member is adjacent to the bottom first disk surface;

wherein the width adjusting mechanism is capable of adjusting the spherical diameter of the spherical member.

* * * * *